US008624832B2

(12) United States Patent
Inoue

(10) Patent No.: US 8,624,832 B2
(45) Date of Patent: Jan. 7, 2014

(54) DRIVE METHOD FOR AN ELECTROPHORETIC DISPLAY DEVICE AND AN ELECTROPHORETIC DISPLAY DEVICE

(75) Inventor: Katsutoyo Inoue, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 634 days.

(21) Appl. No.: 12/260,869

(22) Filed: Oct. 29, 2008

(65) Prior Publication Data

US 2009/0115763 A1 May 7, 2009

(30) Foreign Application Priority Data

Nov. 2, 2007 (JP) ..... 2007-286313
Jun. 19, 2008 (JP) ..... 2008-160463

(51) Int. Cl.
*G09G 3/34* (2006.01)

(52) U.S. Cl.
USPC ..... 345/107

(58) Field of Classification Search
USPC ..... 345/107, 211
See application file for complete search history.

(56) References Cited

U.S. PATENT DOCUMENTS

| | | | | |
|---|---|---|---|---|
| 7,623,113 | B2 * | 11/2009 | Zhou et al. | 345/107 |
| 7,868,869 | B2 * | 1/2011 | Shin et al. | 345/107 |
| 2002/0196207 | A1 * | 12/2002 | Machida et al. | 345/55 |
| 2003/0081305 | A1 * | 5/2003 | Chung et al. | 359/296 |
| 2005/0151463 | A1 * | 7/2005 | Yamamoto et al. | 313/503 |
| 2006/0132895 | A1 * | 6/2006 | Miyazaki | 359/296 |
| 2006/0139301 | A1 * | 6/2006 | Ryu et al. | 345/102 |
| 2006/0170648 | A1 * | 8/2006 | Zhou et al. | 345/107 |
| 2006/0202948 | A1 * | 9/2006 | Johnson et al. | 345/107 |
| 2006/0209388 | A1 * | 9/2006 | Whitesides et al. | 359/296 |
| 2006/0262081 | A1 * | 11/2006 | Zhou et al. | 345/107 |
| 2007/0046623 | A1 * | 3/2007 | Song | 345/107 |
| 2007/0057907 | A1 * | 3/2007 | Ishii et al. | 345/107 |
| 2007/0247417 | A1 * | 10/2007 | Miyazaki et al. | 345/107 |
| 2008/0150887 | A1 * | 6/2008 | Kim et al. | 345/107 |
| 2008/0211734 | A1 * | 9/2008 | Huitema et al. | 345/3.1 |
| 2008/0211833 | A1 * | 9/2008 | Inoue | 345/690 |
| 2009/0223821 | A1 * | 9/2009 | Abe | 204/450 |

FOREIGN PATENT DOCUMENTS

| | | |
|---|---|---|
| EP | 1 950 729 A2 | 7/2008 |
| JP | 52-070791 | 6/1977 |

(Continued)

*Primary Examiner* — Amare Mengistu
*Assistant Examiner* — Sarvesh J Nadkarni

(57) ABSTRACT

A drive method for an electrophoretic display device that has an electrophoretic device composed of a suspension fluid containing electrophoretic particles disposed between a common electrode and a plurality of pixel electrodes, a driver that drives the electrophoretic device by applying voltage between the common electrode and the plural pixel electrodes, and a controller that controls the driver. The control method has a display redrawing process that changes the displayed image by applying a common electrode drive pulse that repeats two different potentials to the common electrode, and applying either of the two different potentials to the pixel electrodes according to the updated display content. The display redrawing process includes a first pulse application step that applies a first pulse train to the common electrode as the common electrode drive pulse train, and a second pulse application step that executes after the first pulse application step to apply a second pulse train to the common electrode as the common electrode drive pulse train, the pulses of the second pulse train being wider than the pulses of the first pulse train.

4 Claims, 14 Drawing Sheets

(56) References Cited

FOREIGN PATENT DOCUMENTS

| | | |
|---|---|---|
| JP | 2007-057274 | 3/2007 |
| JP | 2007-057292 | 3/2007 |
| JP | 2007-519026 A | 7/2007 |
| JP | 2007-256062 | 10/2007 |
| JP | 2007-285748 | 11/2007 |

* cited by examiner

DRIVE METHOD FOR AN ELECTROPHORETIC DISPLAY DEVICE AND AN ELECTROPHORETIC DISPLAY DEVICE

CROSS-REFERENCE TO RELATED APPLICATIONS

Japanese Patent application No.(s) 2007-286313, and 2008-160463, are hereby incorporated by reference in their entirety.

BACKGROUND

1. Field of Invention

The present invention relates to a drive method for an electrophoretic display device and to an electrophoretic display device.

2. Description of Related Art

Electrophoresis, a technique in which Coulomb's force is used to cause electrophoretic particles to migrate by applying an electric field to a suspension fluid having electrophoretic particles dispersed in a fluid, and electrophoretic display devices that operate by means of electrophoresis, are known from the literature. There is, however, still room for improvement with respect to electrophoretic display devices.

A common drive method used in liquid crystal displays and other types of display devices is to vary the potential of the pixel electrode while also changing the potential of the common electrode (a method also referred to herein as "variable common electrode drive"). Japanese Unexamined Patent Appl. Pub. JP-A-S52-70791 is directed a variable common electrode drive method for an electrophoretic display device.

This drive method controls the potential of the pixel electrode and the common electrode to either of two values, that is, either a high potential or a low potential. This enables lowering the voltage of the drive potential, simplifying the circuit design, and low cost manufacture. When thin film transistors (TFT) are used in the drive circuit, lowering the drive potential as described above can also improve TFT reliability.

Problems with this variable common electrode drive method that remain to be solved are described below.

If a pulse signal with a 200 ms pulse width is applied to the common electrode to change the common electrode potential, flicker results and the flicker can induce user stress. More specifically, when the display is driven by varying the common electrode potential, color changes are sharp when drive starts and flicker occurs easily.

This flicker can be prevented by inputting a pulse signal with a short pulse width such as 20 ms for variable common electrode drive. However, because the pulse width for which voltage is applied is short, the particles cannot be moved enough to saturate the display, and only relatively low reflectance can be achieved.

Sufficient reflectance also cannot be achieved with a single write operation because pulse signals with a short pulse width are used. The reflectance of pixels that are redrawn from white to white and the reflectance of pixels that are redrawn from black to white therefore differs in an electrophoretic display device that uses white and black electrophoretic particles, resulting in an uneven display, ghosts, and other problems.

SUMMARY OF INVENTION

The drive method for an electrophoretic display device and the electrophoretic display device according to the present invention suppress flicker and achieve sufficient reflectance (contrast) with a single write operation.

A first aspect of the invention is a drive method for an electrophoretic display device that has an electrophoretic device composed of a suspension fluid containing electrophoretic particles disposed between a common electrode and a plurality of pixel electrodes. The method includes driving the electrophoretic device, using a driver for example, by applying voltage between the common electrode and the plural pixel electrodes, and redrawing the display to change the displayed image by applying a common electrode drive pulse that repeats two different potentials to the common electrode, and applying either of the two different potentials to the pixel electrodes according to the updated display content. The display redrawing process includes a first pulse application step that applies a first pulse train to the common electrode as the common electrode drive pulse, and a second pulse application step, executed after the first pulse application step, that applies a second pulse train to the common electrode as the common electrode drive pulse. Each pulse of the second pulse train has a longer width than that of each pulse of the first pulse train.

The actual pulse widths of the first pulses and the second pulses are set according to the characteristics of the electrophoretic display device that is driven.

More specifically, the pulse width of the first pulses is set to the longest pulse width that will not produce flicker when the first pulse train is applied in the first half of the display redrawing process to the electrophoretic display device that is driven. If a pulse with a relatively long pulse width is applied in the first half of the display redrawing process, flicker results because of the sudden color change at the beginning of the drive period in a variable common electrode drive method. Flicker can be prevented by applying pulses with a short pulse width, but writing the display then becomes time consuming. The first pulses applied in the first half of the display redrawing process therefore preferably has a pulse width that is as long as possible without producing flicker.

The pulse width of the second pulses is set in a range that increases contrast in the displayed image while also preventing a drop in image retention when the second pulse train is applied in the second half of the display redrawing process to the electrophoretic display device that is driven. More specifically, applying a train of longer-width pulses in the second half of the display redrawing process reaches a saturation state that is resistant to flicker because the change in color is subtle. In addition, because contrast increases when the pulse width of the second pulse increases, the lower limit for the pulse width of the second pulses may be set so that the contrast ratio goes to a predetermined level or above. Furthermore, because tests demonstrated that retention of the written image drops if the second pulse width is too long, the upper limit for the pulse width of the second pulse is preferably set so that image retention does not drop.

As described above, the pulse widths of the first pulses and the second pulses are set according to the characteristics of the electrophoretic display device to be driven. For example, the pulse width of the first pulses is preferably less than 25 ms, and the pulse width of the second pulses is preferably greater than or equal to 25 ms. For example, the pulse width of the first pulses may be 20 ms and the pulse width of the second pulses may be 100-200 ms.

Pulse width as used herein means the pulse length of the high level (=V1) portion of a pulse signal that alternates between two different potential levels, such as a pulse signal that alternates between a high level of potential V1 and a low level of a different potential V2. Note that because the pulse width of the high level (V1) and the pulse width of the low level (V2) are the same, the pulse width may also be the pulse length of the low level (=V2) portion of the pulse signal.

Furthermore, by executing the first pulse application step first in the display redrawing process and then executing the second pulse application step, the pulse width of the pulse signal applied to the common electrode can be changed.

Because the pulse width of the first pulses is shorter than the pulse width of the second pulses, movement of the electrophoretic particles is less but flicker that is discernible to the user can be prevented.

While flicker that is discernible to the user is possible when the second pulse train is applied because the width of the second pulses is longer than the width of the first pulses, the electrophoretic particles can be caused to move a greater distance and the electrophoretic particles can be moved to achieve sufficient saturation, that is, until sufficient reflectance is achieved to suitably display black or white.

Therefore, the first pulse train is applied during the period in which flicker may be conspicuous if the second pulse is applied, such as the time from when the display begins to change from black to white until a sufficiently white display is achieved (the first half of the display redrawing process) when changing the display from black to white, and the second pulse train can then be applied during the period in which flicker will not appear even if the second pulse is applied, such as after a sufficiently white display is achieved (the second half of the display redrawing process) when changing the display from black to white.

Flicker can therefore be suppressed and sufficient reflectance (contrast) can be achieved with a single write.

Preferably, the display redrawing process executes the first pulse application step until the reflectance of the changed image reaches a threshold value set to at least 80% or more of the targeted maximum reflectance, and executes the second pulse application step after the threshold value is reached.

The targeted maximum reflectance as used herein means the reflectance that is set as the desired display reflectance with consideration for current consumption, display response, and other characteristics when designing the electrophoretic display device.

For example, the maximum reflectance when displaying black may be set to 4%, 6%, or other reflectance level. When black is displayed the contrast to white increases as the reflectance decreases and display quality thus improves, but an increase in the movement of the black particles increases power consumption and reduces the display response. Therefore, the maximum reflectance when displaying black may be set to balance display quality with power consumption and display response, for example.

The maximum reflectance when displaying white may likewise be set to 47%, 45%, or other reflectance level. When white is displayed the contrast to black increases as the reflectance increases and display quality thus improves, but an increase in the movement of the white particles increases power consumption and reduces the display response. Therefore, the maximum reflectance when displaying white may be set to balance display quality with power consumption and display response, for example.

If, for example, the targeted maximum reflectance when displaying white is set to 47%, the image is changed from black to white, and the threshold value is set to 90% of the maximum reflectance, the first pulse application step is executed until the reflectance reaches the threshold value of 47%×0.9=42.3%, and the second pulse application step is executed when the threshold value of 42.3% is reached.

If the targeted maximum reflectance when displaying black is set to 4%, the image is changed from white to black, and the threshold value is set to 90% of the maximum reflectance, the first pulse application step is executed until the reflectance reaches the threshold value of 13.6%, and the second pulse application step is executed when the threshold value of 13.6% is reached. The threshold value for black can be obtained by substituting −100% for 0% reflectance. For example, if reflectance is 4%, 4−100=−96%, −96%×0.9=−86.4%, and the threshold value=100−86.4=13.6%.

This aspect of the invention can prevent flicker because the display is driven by applying the first pulse until the reflectance reaches the threshold value, which is a known percentage of the targeted maximum reflectance. More specifically, flicker occurs easily in the first half of the drive period drawing the display to a different color because the color change is abrupt. The invention, however, applies the first pulse train with a short pulse width in the first half of the drive period until the reflectance reaches the threshold value, and can therefore prevent flicker.

When the reflectance exceeds the threshold value, however, the invention applies the second pulse to drive the display, and can therefore desirably increase reflectance and improve display quality. More specifically, particle movement reaches a saturation state in the second half of the drive period writing to a different color, the change in color becomes subtle, and flicker does not occur easily. The invention can therefore suppress flicker and improve display quality as a result of applying a second pulse with a long pulse width in the second part of the drive period after the reflectance reaches the threshold value.

The threshold value is usually set in the range of 80% to 90%. If the threshold value is less than 80%, flicker may be apparent when the second pulse is applied because the percentage of change in the reflectance is great. If the threshold value is greater than 90%, the length of the first pulse drive period increases and more time is required to reach the targeted maximum reflectance. The threshold value is therefore preferably set in the range 80-90% depending on the characteristics of the electrophoretic display device.

Depending on the electrophoretic display device, however, the required characteristics can be achieved even if the threshold value is set to less than 80% or more than 90% of the targeted maximum reflectance. More specifically, the threshold value may be set according to the characteristics of the electrophoretic display device in which the invention is used.

Further preferably, the pulse width of the second pulses is in the range of 2 times to 30 times the pulse width of the first pulses.

If the pulse width of the second pulses is less than twice the pulse width of the first pulses, the difference in the pulse widths of the pulses is small, there is little difference in characteristics when the pulse is switched, and effective drive control is not possible.

Furthermore, if the pulse width of the second pulses is more than 30 times the pulse width of the first pulses, the difference in characteristics when the pulse is switched is too great, and effective drive control is not possible. In addition, if the pulse width of the second pulse is too long, image retention may drop when driving stops.

However, by setting the pulse width of the second pulses in the range of 2 to 30 times the pulse width of the first pulses, the change in characteristics when the drive pulse switches is well balanced, effective drive control is possible, and a drop in display retention can be prevented.

Depending on the electrophoretic display device, however, the required characteristics can be achieved even if the pulse width of the second pulses deviates somewhat from this range of 2-30 times the pulse width of the first pulses. In such cases the pulse width of the second pulse may be set outside the range of 2-30 times the pulse width of the first pulse.

In another aspect of the invention the electrophoretic device has electrophoretic particles of a first color for displaying a first color and electrophoretic particles of a second color for displaying a second color, and the sizes of the first-color electrophoretic particles and the second-color electrophoretic particles differ. The common electrode drive pulse repeatedly alternates between a first-color writing voltage that changes the displayed image to the first color and a second-color writing voltage that changes the image to the second color. The last pulses in the common electrode drive pulse train in the display redrawing process correspond to the first-color writing voltage when the electrophoretic particles of the first color are larger than the electrophoretic particles of the second color, and corresponds to the second-color writing voltage when the electrophoretic particles of the second color are larger than the electrophoretic particles of the first color.

The electrophoretic display device has second color particles (such as black particles) and first color particles (such as white particles) dispersed in a suspension fluid inside microcapsules. When the sizes of the particles differ, the larger particles have more resistance to movement during migration and do not move easily. In addition, the large particles can be moved closer to the capsule wall and contrast can be improved by making the last pulse in the display redrawing process a pulse for driving the large particles.

For example, if the first color particles are larger than the second color particles, the final reflectance may drop if the second-color write voltage is applied last after applying the first-color write voltage.

The invention prevents a drop in the final reflectance, however, by applying the first-color writing voltage last.

Further preferably, the first pulse in the common electrode drive pulse stream in the display redrawing process is the first-color writing voltage when the electrophoretic particles of the first color are larger than the electrophoretic particles of the second color, and the first pulse in the common electrode drive pulse stream in the display redrawing process is the second-color writing voltage when the electrophoretic particles of the second color are larger than the electrophoretic particles of the first color.

The common electrode drive pulse starts by applying the writing voltage for moving the large particles, then alternately applies the write voltage for both particles, and ends by applying the writing voltage for moving the large particles. For example, if the first-color particles are larger than the second-color particles, driving starts by applying the voltage for writing the first color, the voltage for writing the second color and the voltage for writing the first color are then alternately applied, and driving ends by applying the voltage for writing the first color.

This aspect of the invention thus enables applying the voltage for writing the color of the large particles more times than the voltage for writing the color of the small particles is applied.

In an electrophoretic display device particles with a large particle size move more slowly than small particles. Therefore, by increasing the number of times the voltage for writing the color of the large particles is applied, the slowly migrating large particles can also be caused to move sufficiently and display quality can be improved.

Another aspect of the invention is an electrophoretic display device that has an electrophoretic device composed of a suspension fluid containing electrophoretic particles disposed between a common electrode and a plurality of pixel electrodes. A driver drives the electrophoretic device by applying voltage between the common electrode and the plural pixel electrodes; and a controller controls the driver. The controller has a display redrawing component that changes the displayed image by applying a common electrode drive pulse that repeats two different potentials to the common electrode, and applying either of the two different potentials to the pixel electrodes according to the updated display content. The display redrawing component includes a first pulse application unit that applies a first pulse train to the common electrode as the common electrode drive pulse train, and a second pulse application unit that operates after the first pulse application unit and that applies a second pulse train to the common electrode as the common electrode drive pulse train. The pulse width of the second pulses having a width that is longer than the width of the first pulses.

This aspect of the invention can change the pulse width of the pulse signal applied to the common electrode because the display redrawing component that writes images has a first pulse application unit and a second pulse application unit.

Furthermore, because the pulse width of the first pulses is shorter than the pulse width of the second pulses, movement of the electrophoretic particles is less but flicker that is discernible to the user can be prevented.

While flicker that is discernible to the user is possible when the second pulse train is applied because it has longer-width pulses than does the first pulse train, the electrophoretic particles can be caused to move a greater distance and the electrophoretic particles can be moved to achieve sufficient saturation, that is, until sufficient reflectance is achieved to suitably display black or white.

Therefore, the first pulse train is applied during the period in which flicker may be conspicuous if the second pulse train is applied, such as the time from when the display begins to change from black to white until a sufficiently white display is achieved when changing the display from black to white, and the second pulse train can then be applied during the period in which flicker will not appear even if the second pulse train is applied, such as after a sufficiently white display is achieved when changing the display from black to white.

Flicker can therefore be suppressed and sufficient reflectance (contrast) can be achieved with a single write.

The drive method for an electrophoretic display device and the electrophoretic display device according to the present invention can thus suppress flicker and achieve sufficient reflectance (contrast) with a single write operation.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
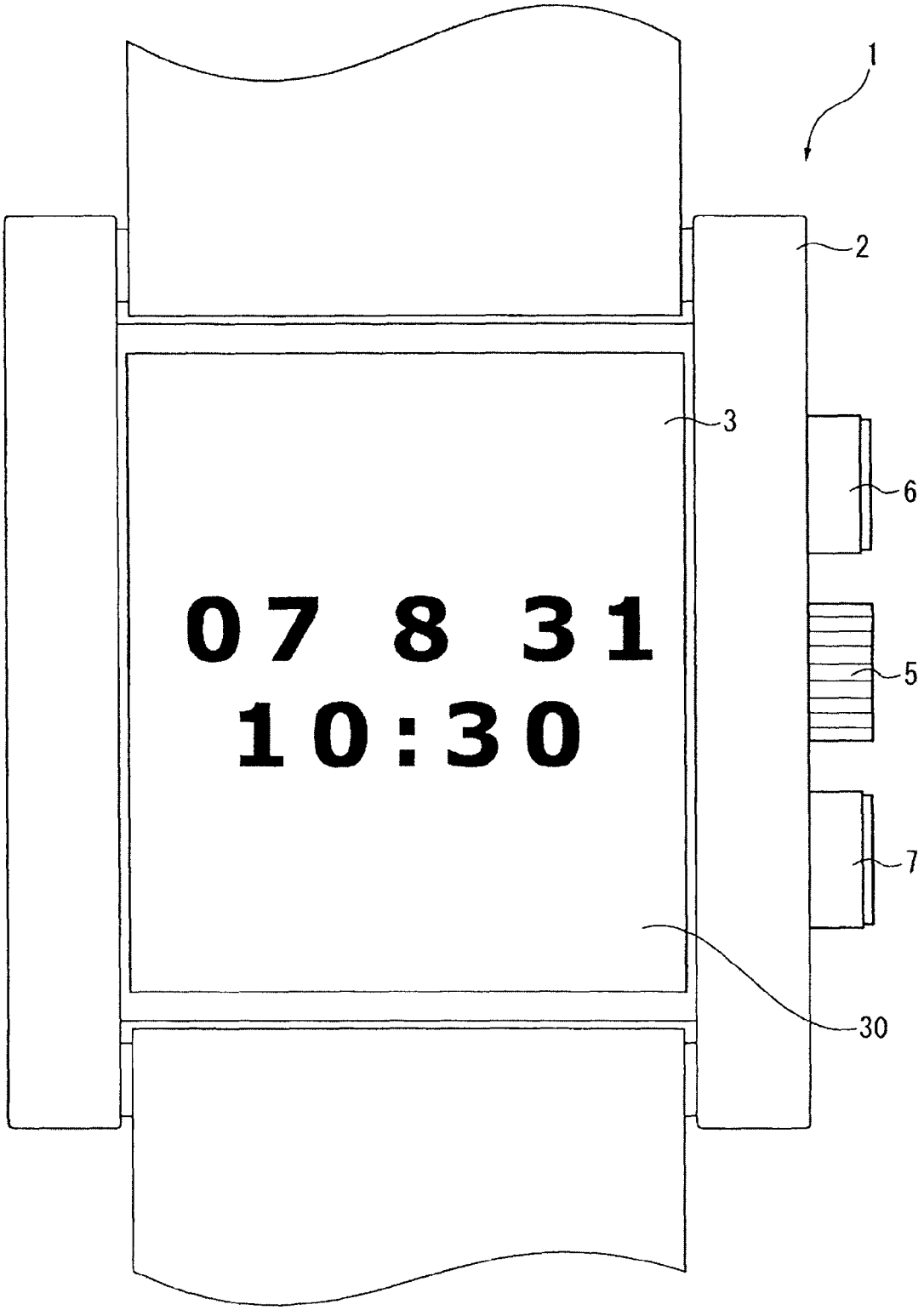
FIG. 1 is a front view of a timepiece according to a first embodiment of the invention.

Preferred embodiments of the present invention are described below with reference to the accompanying figures. Note that in the second and other embodiments parts that are functionally the same as parts that have already been described in the first or other preceding embodiment are identified by the same reference numerals, and further description thereof is omitted.

Embodiment 1

A first embodiment of the invention is described next with reference to FIG. 1 to FIG. 11.

1. General Configuration

FIG. 1 is a front view of an electronic timepiece 1 that uses an electrophoretic display device according to a preferred embodiment of the invention. The electronic timepiece 1 has a rectangular case 2 and an electrophoretic display device 3. A crown 5, and buttons 6 and 7 are disposed to the case 2.

2. Electrophoretic Display Device

Figure 2:
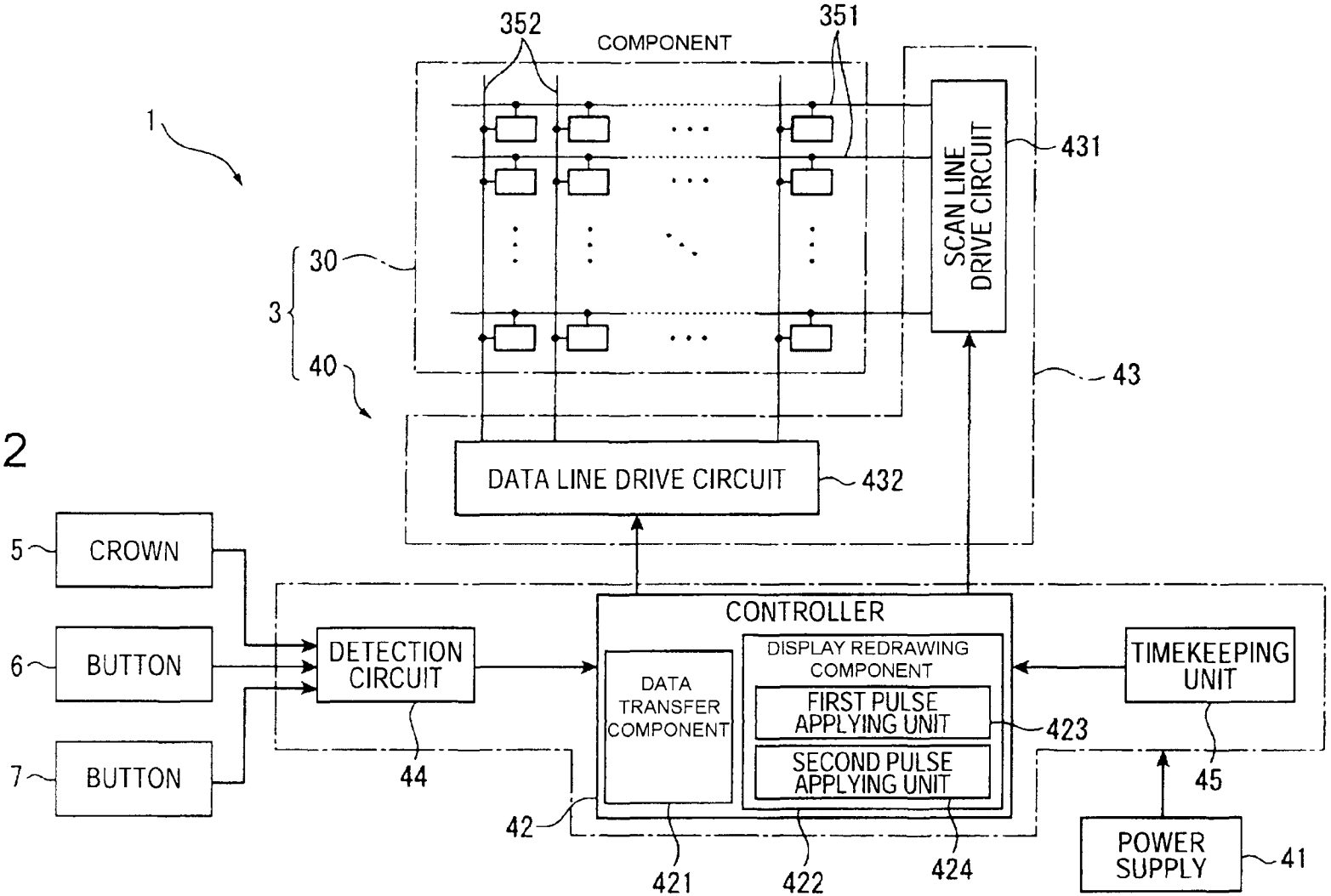
FIG. 2 is a block diagram of the circuit configuration of a timepiece according to this embodiment of the invention.

As shown in FIG. 2 the electrophoretic display device 3 includes a display panel 30 and a drive controller 40 that drives the display panel 30 and includes a timekeeping unit.

3. Drive Controller

The drive controller 40 includes a power supply 41, a controller 42 that controls the timepiece 1, a drive circuit 43, a detection circuit 44, and a timekeeping unit 45.

The drive circuit 43 is rendered by a driver IC and controls displaying content on the display panel 30.

The detection circuit 44 detects operation of the crown 5 and buttons 6 and 7.

The timekeeping unit 45 has a crystal oscillator circuit and keeps the time.

The controller 42 controls the drive circuit 43, and includes a data transfer component 421 and a display redrawing component 422. The display redrawing component 422 includes a first pulse applying unit 423 and a second pulse applying unit 424.

The data transfer component 421 includes an image signal processing circuit and a timing generator. The data transfer component 421 produces the display data for the images and text to be displayed on the display panel 30, and generates the refresh data for sustaining the display, and outputs to the drive circuit 43.

The first pulse applying unit 423 and second pulse applying unit 424 of the display redrawing component 422 output pulse signals (common electrode drive pulses) to the common electrodes (not shown in FIG. 2) in conjunction with output of display data and refresh data from the data transfer component 421.

The drive circuit 43 controls the display panel 30 based on signals output from the controller 42. As further described below, the display panel 30 in this embodiment of the invention is an active matrix drive device and has a low temperature polysilicon TFT circuit for driving the pixels.

As a result, the drive circuit 43 has a scan line drive circuit 431 that outputs a predetermined scan line signal to the scan lines of the TFT circuit, and a data line drive circuit 432 that outputs predetermined data line signals to the data lines of the TFT circuit.

4. Display Panel

Figure 3:
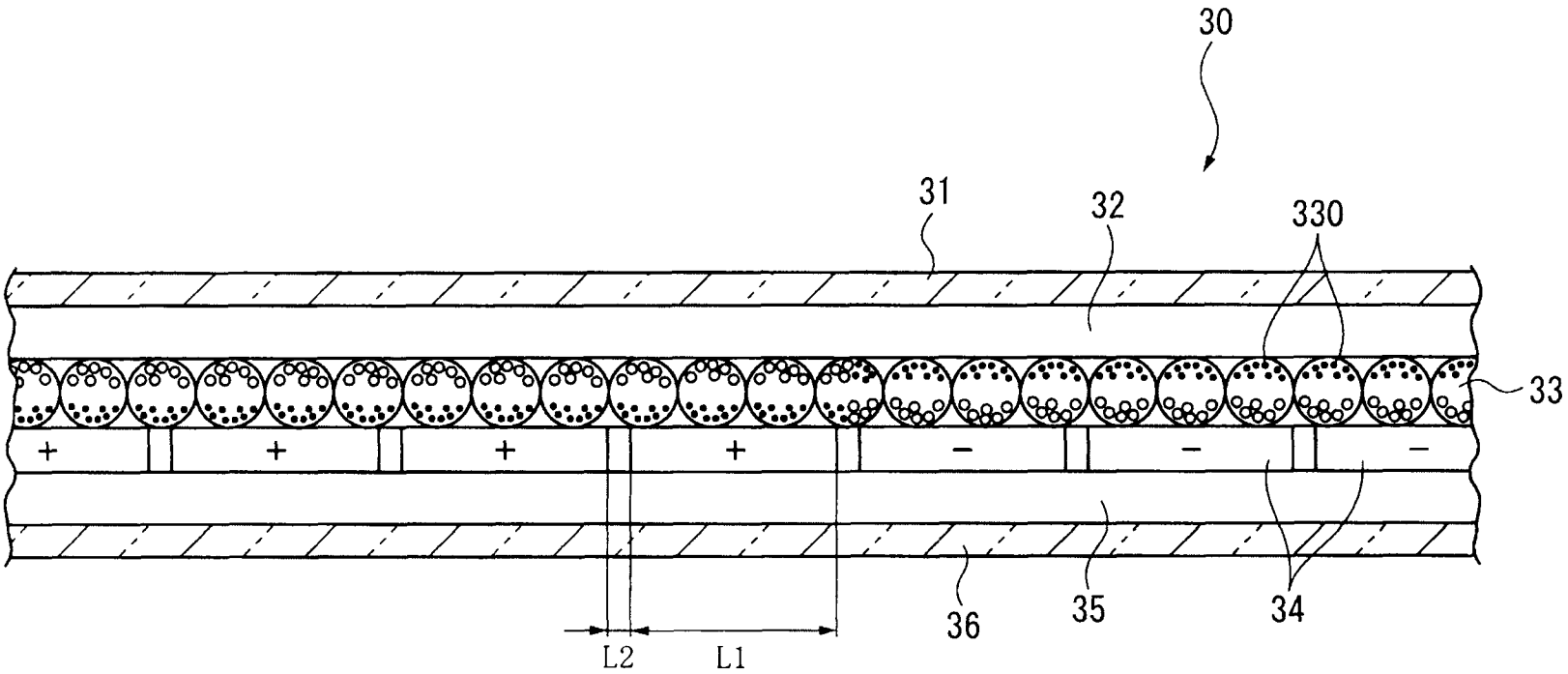
FIG. 3 is a section view of the display panel in the preferred embodiment of the invention.

As shown in FIG. 3, the display panel 30 is a layered construction having in order from the display side a front glass 31, a common electrode 32, an electrophoretic layer 33, pixel electrodes 34, a TFT circuit layer 35, and a back glass 36. The front glass 31 and back glass 36 are not limited to transparent glass, and could be made of a transparent plastic.

The TFT circuit driven by the scan line drive circuit 431 and data line drive circuit 432 is rendered in the TFT circuit layer 35. As shown schematically in FIG. 2, the TFT circuit layer 35 includes a plurality of mutually perpendicular scan lines 351 and data lines 352. A switching transistor and a memory cell not shown are disposed at each of the intersections between the scan lines 351 and data lines 352. Each transistor is connected to one of the pixel electrodes 34, which are disposed for each pixel of the display, and controls the voltage supply to the pixel electrode 34.

The common electrode 32 is made from a transparent electrode material such as indium tin oxide (ITO). The common electrode 32 is disposed over substantially the entire area of the display panel 30. In other words, the pixel electrodes 34 are disposed for each pixel of the display panel 30, but the common electrode 32 is common to all of the pixels.

Figure 4:
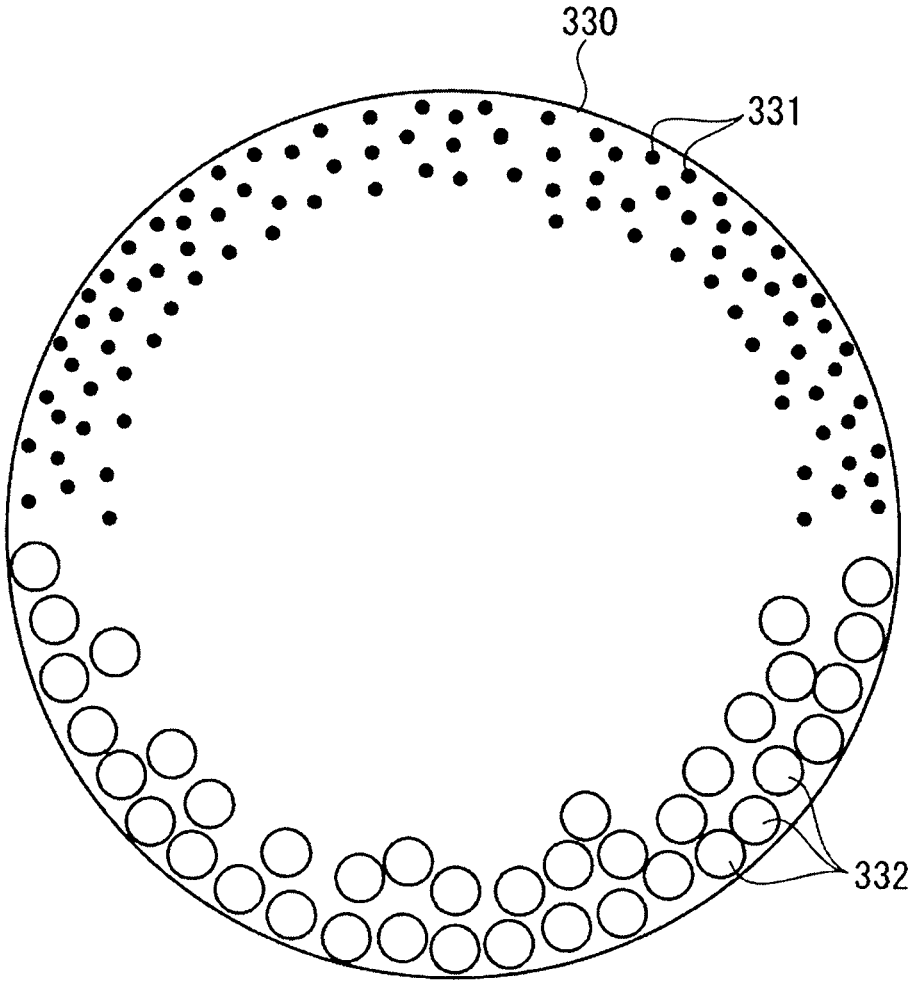
FIG. 4 schematically describes the microcapsules in this embodiment of the invention.

The electrophoretic layer 33 includes numerous microcapsules 330 bonded to the common electrode 32. As also shown in FIG. 4, the microcapsules 330 are filled with an electrophoretic particle suspension fluid in which numerous charged particles are dispersed. Both black electrophoretic particles ("black particles" below) 331 and white electrophoretic particles ("white particles" below) 332 are dispersed in the electrophoretic particle suspension fluid, rendering an electrophoretic layer with a two color particle dispersion. The black particles 331 and white particles 332 are oppositely charged, and in this embodiment of the invention the black particles 331 are negatively charged while the white particles 332 are positively charged.

The diameter of the microcapsules 330 in this embodiment of the invention is approximately 30 μm (0.03 mm), the diameter of the black particles 331 is 10-30 nm, and the diameter of the white particles 332 is 100-300 nm.

As shown in FIG. 3, the width L1 of the pixel electrodes 34 is approximately 0.09 mm, and the width L2 of the gap between the pixel electrodes 34 is approximately 0.01 mm.

In this embodiment of the invention white is the first color in the accompanying claims and the first-color particles are rendered by the white particles 332. Black is the second color in the accompanying claims, and the second-color particles are rendered by the black particles 331.

The sides of the display panel 30 are sealed with a seal material between the front glass 31 and back glass 36. The front glass 31, back glass 36, and sealing material thus render a sealed enclosure containing the electrophoretic layer 33.

5. Displaying Content Using Electrophoresis

When a potential difference is created between the common electrode 32 and pixel electrodes 34, the black particles 331 and white particles 332 in the microcapsules 330 migrate and the color displayed by each microcapsule 330 changes when seen from the front glass 31 side.

More specifically, when the pixel electrode 34 goes to a low potential (L potential, denoted "–" in FIG. 3) and the common electrode 32 goes high (H potential), the potential difference creates a field from the common electrode 32 to the pixel electrodes 34. This causes the positively charged white particles 332 to move to the pixel electrode 34 side and the negatively charged black particles 331 to move to the common electrode 32 side. As a result, when the potential of the pixel electrode 34 is low relative to the potential of the common electrode 32, the display color becomes black when seen from the front glass 31 side.

When the field is reversed from this black display by driving the pixel electrode 34 to a high potential (H potential, denoted "+" in FIG. 3) and the common electrode 32 to a low potential (L potential), reversal of the field changes the color displayed on the display panel 30 to white.

Gray levels between black and white can also be displayed by changing the time voltage is applied to adjust the distance moved by the black particles 331 and white particles 332.

When applying the field stops, movement of the black particles 331 and white particles 332 also stops, and the color displayed at that time remains displayed.

6. Driving the Display Panel

The drive process for driving the display panel 30 is described next.

Figure 5:
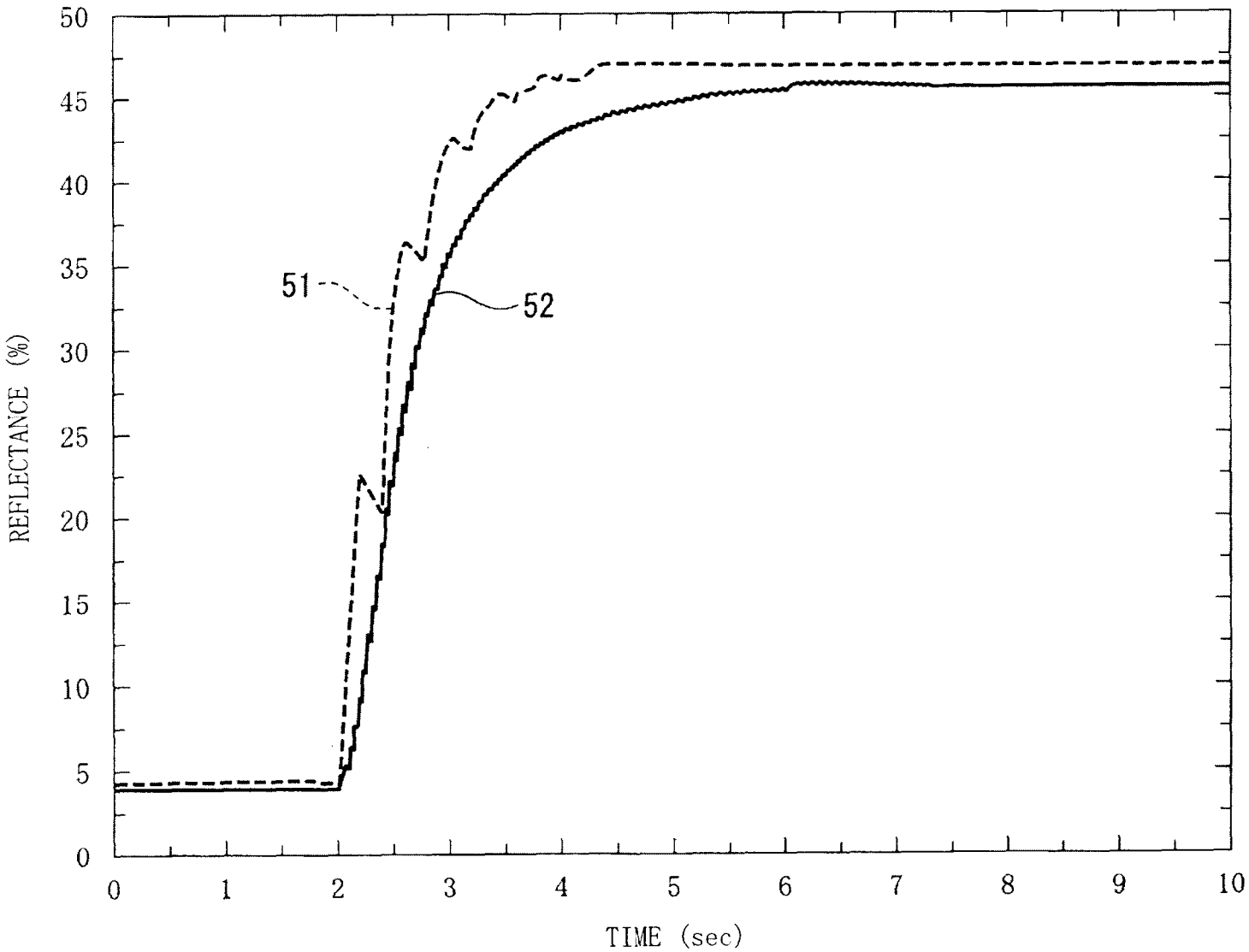
FIG. 5 is a graph showing the change in reflectance with a drive method used for comparison with this embodiment of the invention.

The drive characteristics of the display panel 30 are described first. When the display is driven using the variable common electrode drive method described above, a rectangular pulse signal that alternately applies a high potential and a low potential is input to the common electrode 32. FIG. 5 shows the change in reflectance when a first pulse with a pulse width of 20 ms is applied and when a second pulse that is longer than the first pulse and in this example has a pulse width of 100 ms is applied.

The reflectance was determined by measuring the display on the display panel 30 using a reflectometer. The reflectance of the display panel 30 according to this embodiment of the invention was approximately 4% when black is displayed and approximately 45-47% when white is displayed as shown in FIG. 5.

In the example shown in FIG. 5, the initial reflectance was approximately 4% displaying black, and the display changed to white when a drive signal was applied after 2 seconds as indicated on the x-axis in the figure.

The dotted curve 51 in FIG. 5 denotes the change in reflectance when the second pulse was applied to the common electrode 32. Because the pulse width of the second pulse is long, specifically 100 ms, the change in reflectance is sharp. However, because the reflectance drops when the second pulse changes from low to high and this drop in reflectance is relatively large, it appears as flicker to the viewer.

The final reflectance is approximately 47%, however, and the quality of the white display is superior to that represented by solid curve 52.

The solid curve 52 in FIG. 5 denotes the change in reflectance when the first pulse is applied to the common electrode 32. Because the first pulse is a short 20 ms, the change in reflectance is smoother than the change denoted by curve 51, but the drop in reflectance when the first pulse switches from low to high is less and is not perceived as flicker.

However, the final reflectance is approximately 45%, and the quality of the white display is inferior to that denoted by the dotted curve 51.

When the pulse applied to the common electrode 32 changes from low to high, a high signal is applied to the pixel electrodes 34 displaying white, the same voltage potential is thus applied to the common electrode 32 and the pixel electrode 34, a potential difference theoretically does not occur between the electrodes 32 and 34, the particles 331 and 332 therefore should not move and reflectance should not drop.

In practice, however, reflectance drops as a result of various other factors, including the effect from any adjacent pixel electrode 34 to which a low signal is applied to display black, and voltage drops resulting from leakage current in the TFT circuit layer 35.

The present invention determines the display characteristic achieved by the pulse width of the pulse signal applied to the common electrode 32, and controls driving the display so that flicker is not apparent and display quality can be improved.

In other words, in the process that redraws the display, a first pulse of a short pulse width is applied and a second pulse of a longer pulse width is then applied to improve display quality.

How this control method can prevent flicker and improve display quality is described next with reference to FIG. 6.

Figure 6:
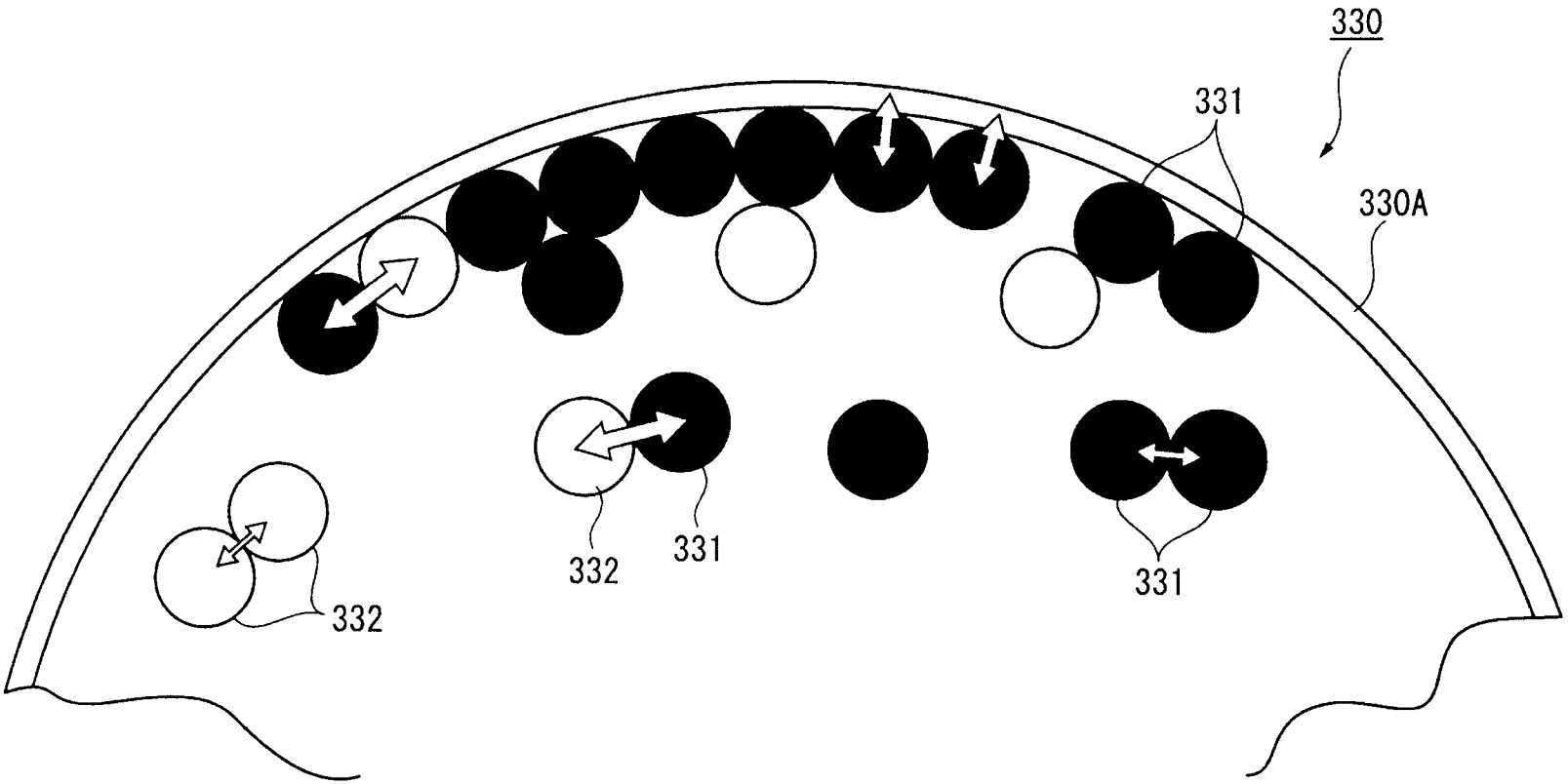
FIG. 6 is a graph showing the energy that works between the capsule wall and the particles in this embodiment of the invention.

FIG. 6 schematically shows the microcapsules 330 with the black particles 331 and white particles 332. The particles 331 and 332 are shown the same size in FIG. 6 for illustrative purposes only.

As described above, the particles 331 and 332 are charged. As a result, energy (attraction) works between the particles 331 and 332 and the capsule wall 330A, and between the individual particles 331 and 332.

Because particles of different colors, that is, black particles 331 and white particles 332, are oppositely charged (positive and negative), they are held together by a strong force.

Because particles of the same color are identically charged, that is, all black particles 331 are charged the same and all white particles 332 are charged the same way, particles of the same color are held together by a weak force because of the difference in the charge between the individual particles 331 and 332.

The energy that works between the individual particles 331 and 332, and between the particles 331 and 332 and the capsule wall 330A, is indicated by arrows in FIG. 6. The thickness and length of the arrows represents the strength of the energy, and the strength of the energy at work increases as the thickness and length of the arrow increases.

When the displayed image is redrawn, the energy (force of attraction) working between the particles 331 and 332 must be overcome in order to cause the particles 331 and 332 to move. More specifically, the particles 331 and 332 must be pulled away from the other particles 331 and 332 or the capsule wall 330A, caused to move to the capsule wall 330A on the other side, and pushed against that capsule wall 330A with sufficient force. As a result, the pulse width of the pulse applied to redraw the display (the first pulse or the second pulse) must be greater than or equal to a predetermined pulse width in order to apply sufficient energy.

However, flicker occurs if the pulse width is too long. More specifically, because the energy working between the particles 331 and 332 is high if the pulse width is long, the distance moved by the particles 331 and 332 also increases. When the voltage of the applied pulse changes, a potential difference occurs even between electrodes 32 and 34 that theoretically should go to the same potential, and the distance moved in the opposite direction by the particles 331 and 332 therefore also increases when the pulse width is long.

For example, if black particles 331 are gathered on the viewing side of the microcapsules 330 as shown in FIG. 6 and a pulse with a pulse width great enough to move the black particles 331 to the opposite side is applied, the migration distance of the black particles 331 increases because a high energy force is applied and the black particles 331 move far inside the suspension fluid. As a result, the black particles 331 move to a position where they cannot be discerned from the front surface side.

If the potential of the pulse applied to the common electrode 32 then changes from low to high, a potential difference theoretically does not occur between the electrodes 32 and 34 and the particles 331 and 332 should not move. In practice, however, other factors such as the electric fields between adjacent electrodes of different voltages and a voltage drop caused by horizontal leakage current produce a potential change that causes the black particles 331 to also move in the opposite direction to a position where they cannot be discerned from the front surface side, for example. The reflectance therefore changes greatly in a short time as shown in FIG. 5, and flicker results.

If the pulse width is short, however, the migration distance of the particles 331 and 332 decreases and the return distance also decreases. The relative change in reflectance is therefore small and flicker does not occur as shown in FIG. 5.

In addition, when the particles 331 and 332 move enough inside the microcapsules 330 that movement cannot be discerned and a pulse with a large pulse width (second pulse) is applied, the change in reflectance is relatively small and flicker does not occur.

For example, if the black particles 331 are moving from the viewing side of the microcapsules 330 to the back side, a pulse with a large pulse width is applied after the black particles 331 are not visible to cause the black particles 331 to move a greater distance, and the potential of the common electrode 32 then changes, the black particles 331 will return slightly in the opposite direction. The distance that the black particles 331 return is less than the distance they migrated, however, and movement of the black particles 331 therefore remains indiscernible. The change in reflectance is therefore reduced and flicker does not occur as shown in FIG. 5.

If the second pulse is applied in the latter half of the redrawing process, a high energy force can be applied to the particles 331 and 332. The particles 331 and 332 can therefore be caused to migrate to the opposite wall of the microcapsules 330 and pushed sufficiently to that wall, and contrast can therefore be improved.

However, tests demonstrated that if the pulse width of the second pulse is too long, the pigment particles 331 and 332 do not stop moving when driving stops, the color therefore fades, and image retention drops.

Applying pulses with a short pulse width (first pulses) in the first part of the redrawing process (from the beginning to the middle) is therefore preferable in terms of preventing flicker, while applying with a long pulse width (second pulse) in the second half (from the middle to the end) of the process is preferable in terms of improving contrast.

Therefore, because movement of the particles 331 and 332 is short if the pulse width is short, the pulse width of the first pulse is preferably set as long as possible within the range that does not produce flicker.

On the other hand, because the force of attraction holding the particles 331 and 332 to the capsule wall 330A weakens and contrast drops if the pulse width is short while the particles 331 and 332 do not stop and image retention drops if the pulse width is too long, the second pulse is set to a pulse width within the range that can maintain the desired contrast while also preventing a loss of image retention.

The drive method of the electrophoretic display device 3 is described next with reference to the flow charts in FIG. 7 and FIG. 8.

Figure 7:
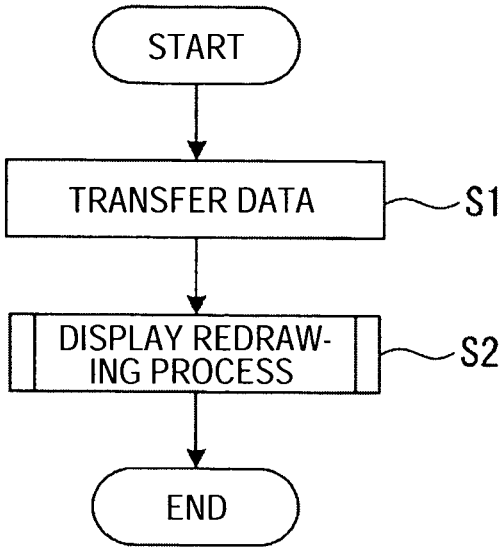
FIG. 7 is a flow chart of the display process in a preferred embodiment of the invention.

As shown in the flow chart in FIG. 7, the controller 42 first controls the drive circuit 43 by means of the data transfer component 421 to execute a data transfer process for sending data to each pixel (S1).

The display redrawing component 422 of the controller 42 then executes the display redrawing process (S2) to redraw the image presented on the display panel 30 based on the transferred data.

Figure 8:
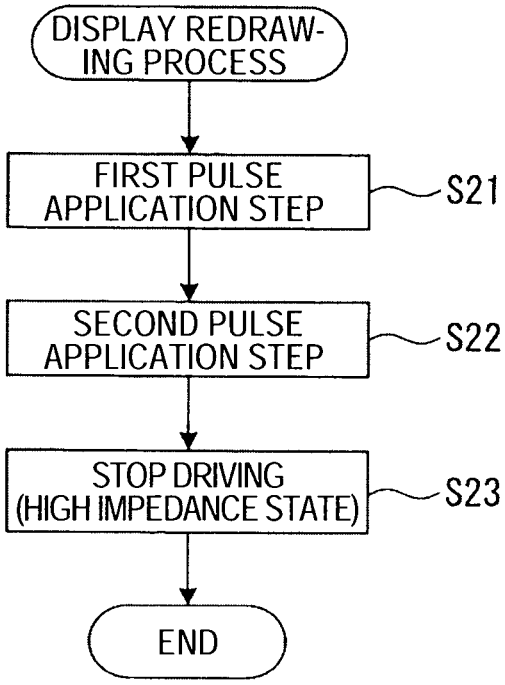
FIG. 8 is a flow chart of the display redrawing process in a preferred embodiment of the invention.
Figure 9:
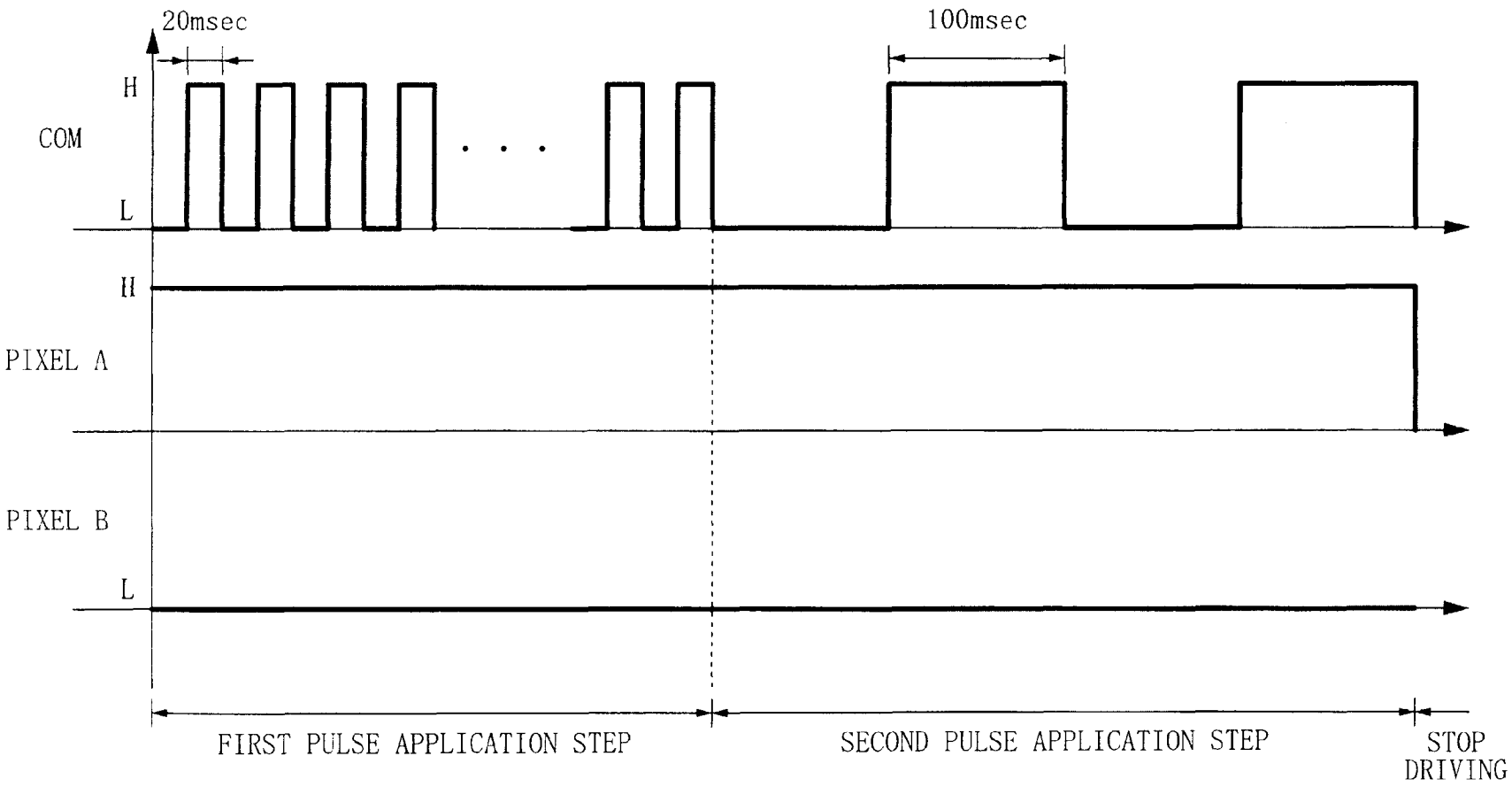
FIG. 9 is a timing chart showing the drive signal in a preferred embodiment of the invention.

In the display redrawing process (S2) as shown in FIG. 8, the first pulse applying unit 423 of the controller 42 applies the first pulse to the common electrode 32 (S21). In this embodiment of the invention as shown in FIG. 9 the first pulse applied to the common electrode 32 (COM) is a rectangular pulse signal with a pulse width (the parts of the signal that are high and low) of 20 ms. The first pulse is thus a pulse signal with a period of 40 ms.

The first pulse applying unit 423 applies the first pulse a predetermined number of times. This number of times may be set based on the results of tests determining how many pulses are required to reach a predetermined percentage (such as 80-90%) of a maximum reflectance set as the target reflectance of the display panel 30. To change a pixel displaying black to white, the first pulse applying unit 423 in this embodiment of the invention is set to output 100 cycles of the first pulse having a 40 ms period, or more specifically to output the first pulse for 40 ms×100=4 seconds.

The controller 42 also outputs a low signal to the pixel electrode 34 for pixels displaying black and a high signal for pixels displaying white in the display redrawing process (S2).

In the timing chart shown in FIG. 9 pixel A displays white and a high signal is therefore output to the pixel electrode 34. Pixel B displays black, and a low signal is therefore output to the pixel electrode 34.

Figure 10:
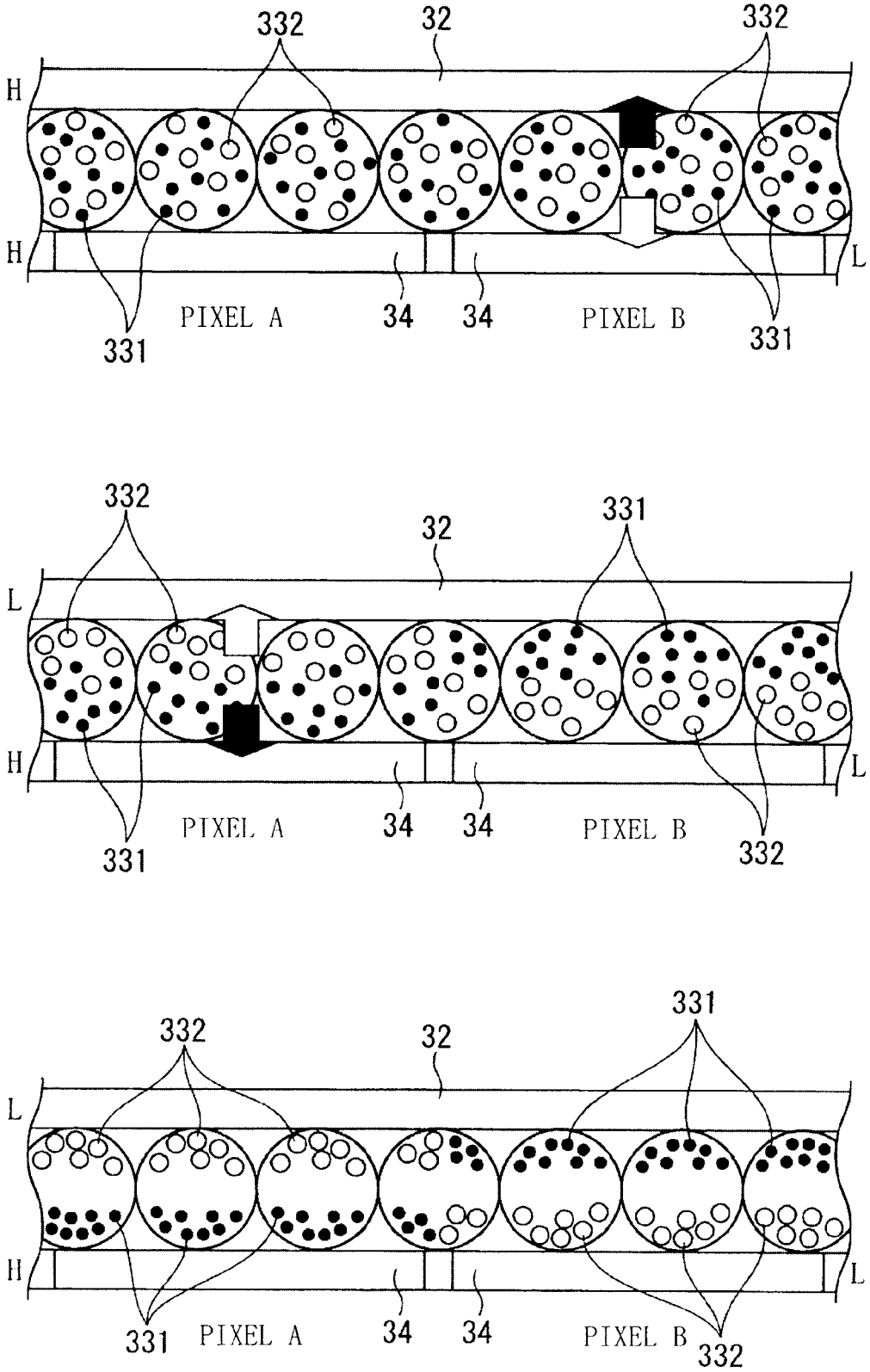
FIG. 10 describes redrawing the display in a preferred embodiment of the invention.

FIG. 10 schematically describes the movement of the black particles 331 and white particles 332 when signals of different levels are applied to the common electrode 32 and the pixel electrode 34.

As shown in FIG. 10A, when a high signal is applied to the common electrode 32 and the same high signal is applied to pixel A, a potential difference does not occur between the common electrode 32 and pixel electrode 34, and the particles 331 and 332 do not move.

However, when a high signal is applied to the common electrode 32 and a low signal is applied to pixel B, a potential difference occurs between the common electrode 32 and the pixel electrode 34. As a result, the negatively charged black particles 331 migrate to the common electrode 32 to which the high signal was applied, and the positively charged white particles 332 migrate to the pixel electrode 34 to which the low signal was applied.

As shown in FIG. 10B, when a low signal is applied to the common electrode 32 and the same low signal is applied to pixel B, a potential difference does not occur between the common electrode 32 and pixel electrode 34, and the particles 331 and 332 do not move.

However, when a low signal is applied to the common electrode 32 and a high signal is applied to pixel A, a potential difference occurs between the common electrode 32 and the pixel electrode 34. As a result, the positively charged white particles 332 migrate to the common electrode 32 to which the low signal was applied, and the negatively charged black particles 331 migrate to the pixel electrode 34 to which the high signal was applied.

In this embodiment of the invention, therefore, when the common electrode 32 is high, a low signal is applied to the pixel electrode 34 of the pixel selected to display black in order to redraw that pixel black. When the common electrode 32 is low, a high signal is applied to the pixel electrode 34 of the pixel selected to display white to redraw that pixel white.

Because the first pulse starts low, which embodiment of the invention first writes white, then alternately writes black and then white, and finally ends by writing black. The second pulse also starts low and therefore first writes white, then alternately writes black and then white, and finally ends by writing black.

While writing white and writing black actually alternate at precise 20 ms intervals, the switching time is short and the display therefore appears to the user to change simultaneously.

Figure 11:
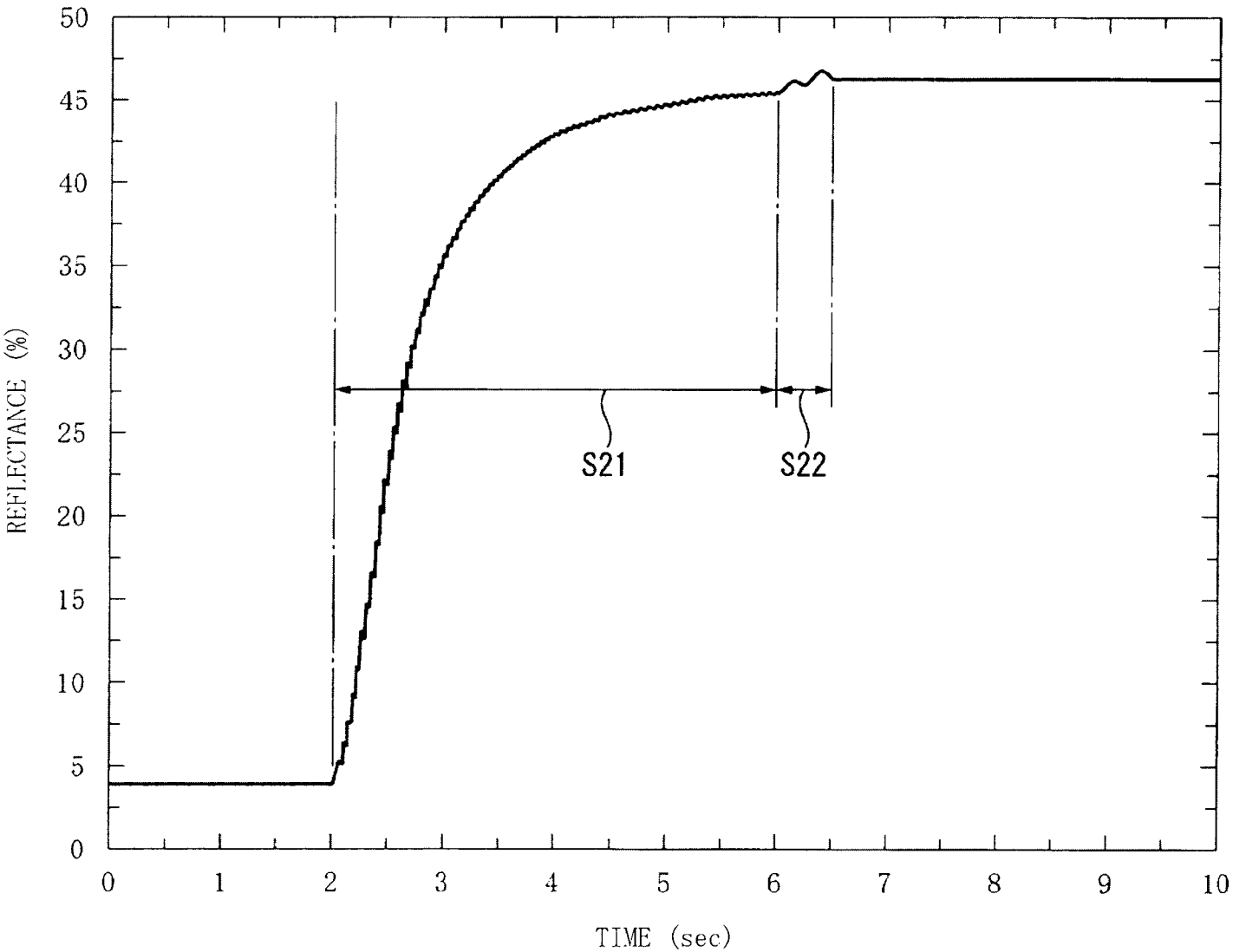
FIG. 11 is a graph showing the change in reflectance with the drive method of the invention.

Because the pulse width of the first pulse applied to the common electrode 32 in the first pulse application step S21 is a short 20 ms, the drop in reflectance when switching the signal level of the first pulse is small. This drop in reflectance occurs when the first pulse changes from low to high when redrawing the display from black to white as shown in FIG. 11, but can be made small enough to be indiscernible as flicker to the user viewing the display panel 30 by driving the first pulse with a short pulse width of 20 ms, for example. Stress-inducing flicker can therefore be prevented.

When the first pulse application step S21 ends, the second pulse applying unit 424 of the controller 42 applies the second pulse to the common electrode 32 (S22). As shown in FIG. 9. The second pulse in this embodiment of the invention is a rectangular wave with a pulse width (the parts of the signal that are high and low) of 100 ms. The second pulse is thus a pulse signal with a period of 200 ms.

The second pulse applying unit 424 applies the second pulse a predetermined number of times. This number of times may be set based on the results of tests determining how many pulses are required to reach a maximum reflectance set for the display panel 30. To change a pixel displaying black to white, the second pulse applying unit 424 in this embodiment of the invention is set to output 2 cycles of the second pulse having a 100 ms period, or more specifically to output the second pulse for 200 ms×2=0.4 second.

When the second pulse application step S22 ends, the black particles 331 and white particles 332 have respectively moved to the common electrode 32 and pixel electrode 34 sides in pixels A and pixels B as shown in FIG. 10C, and the display as seen from the common electrode 32 or front glass 31 side appears white in pixels A and black in pixels B.

Because the second pulse application step S22 uses the second pulses having a longer pulse width than the first pulses, the drop in reflectance is somewhat greater as shown in FIG. 11, but the display is already near the maximum reflectance and the drop in flicker is suppressed to an indiscernible level. Furthermore, because the pulse width of the second pulse is approximately five times longer than the first pulse, the time voltage is applied by one pulse is longer, movement of the particles 331 and 332 increases and the change in reflectance can be increased accordingly. As a result, the final reflectance attained at the completion of the second pulse application step S22 is higher than if only the first pulse is used, and the display quality can therefore also be improved.

When the second pulse application step S22 ends, the controller 42 stops inputting signals to the common electrode 32 and pixel electrodes 34, and the electrodes 32 and 34 are controlled to a high impedance state (S23). When driving stops (S23), a potential difference is not produced between the common electrode 32 and pixel electrode 34, and the image drawn by the display redrawing process S2 (first pulse application step S21 and second pulse application step S22) continues to be displayed on the display panel 30.

The controller 42 controls refreshing the display according to the flow charts in FIG. 7 and FIG. 8 each time the image displayed on the display panel 30 is updated. For example, if time information such as the year, month, day, hour, and minute are displayed as shown in FIG. 1, displaying the minute is updated every minute, and the controller 42 therefore controls updating the display every minute in the pixel area where the minute is displayed. The controller 42 also controls updating the display in the areas displaying other data units at the appropriate update intervals.

The effect of this embodiment of the invention is described next.

(1) By executing the first pulse application step S21 first in the display redrawing process S2, the drop in reflectance can be minimized and flicker can be prevented. In addition, by executing the second pulse application step S22 at the end of the display redrawing process S2, greater reflectance can be achieved than if only the first pulse is applied to the common electrode 32, greater contrast can be achieved in the electrophoretic display elements, and display quality can be improved.

The display panel 30 using electrophoretic display elements can therefore be redrawn smoothly with high display quality, and display characteristics can be improved without inducing stress in the user.

(2) The total drive time of the display redrawing process S2 is substantially the same as when the display is driven using only one type of pulse as shown in FIG. 5, and an increase in power consumption can therefore be prevented. Therefore, because power consumption when holding the displayed image is zero, the method of the invention does not interfere with the characteristics of a low power consumption electrophoretic display device.

(3) By applying both a first pulse application step S21 and a second pulse application step S22, saturation drive causing the particles 331 and 332 to move completely to one of the electrodes 32 and 34 is possible. Ghosting in which the previously displayed image reappears can therefore be reduced.

Embodiment 2

A timepiece according to a second embodiment of the invention is described next.

Figure 12:
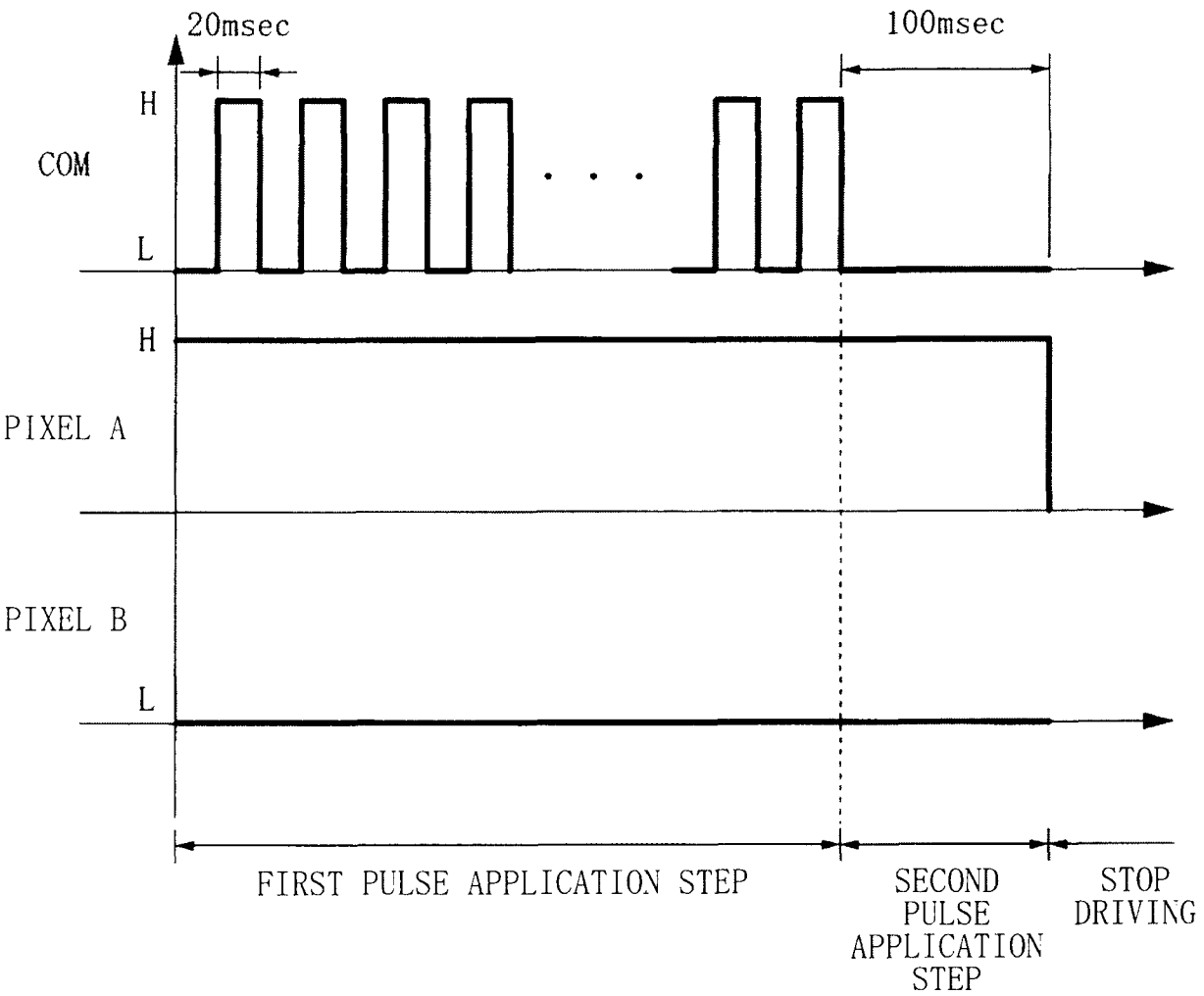
FIG. 12 is a timing chart showing the drive signal in a second embodiment of the invention.

The timepiece according to this second embodiment of the invention differs from the timepiece of the first embodiment in that the number of drive pulses applied by the controller 42, and specifically the number of second pulses input in the second pulse application step S22, differs from the number of pulses applied in the first embodiment as shown in FIG. 12. Other aspects of this embodiment are the same as in the first embodiment, and further description thereof is omitted or simplified.

The controller 42 controls updating the display according to the flow charts shown in FIG. 7 and FIG. 8 and described in the first embodiment above.

As shown in FIG. 12, the controller 42 (first pulse applying unit 423) controls the first pulse application step S21 as described in the first embodiment. A first pulse is therefore applied to the common electrode 32, a high signal is applied to the pixels A that are to display white, and a low signal is applied to the pixels B that are to display black.

After executing the first pulse application step S21 for 4 seconds, the second pulse applying unit 424 of the controller 42 then executes the second pulse application step S22. In the second pulse application step S22 the controller 42 applies one low second pulse with a 100 ms pulse width to the common electrode 32.

The controller 42 then executes the stop driving step S23 to stop applying signals and hold the electrodes 32 and 34 in the high impedance state.

Figure 13:
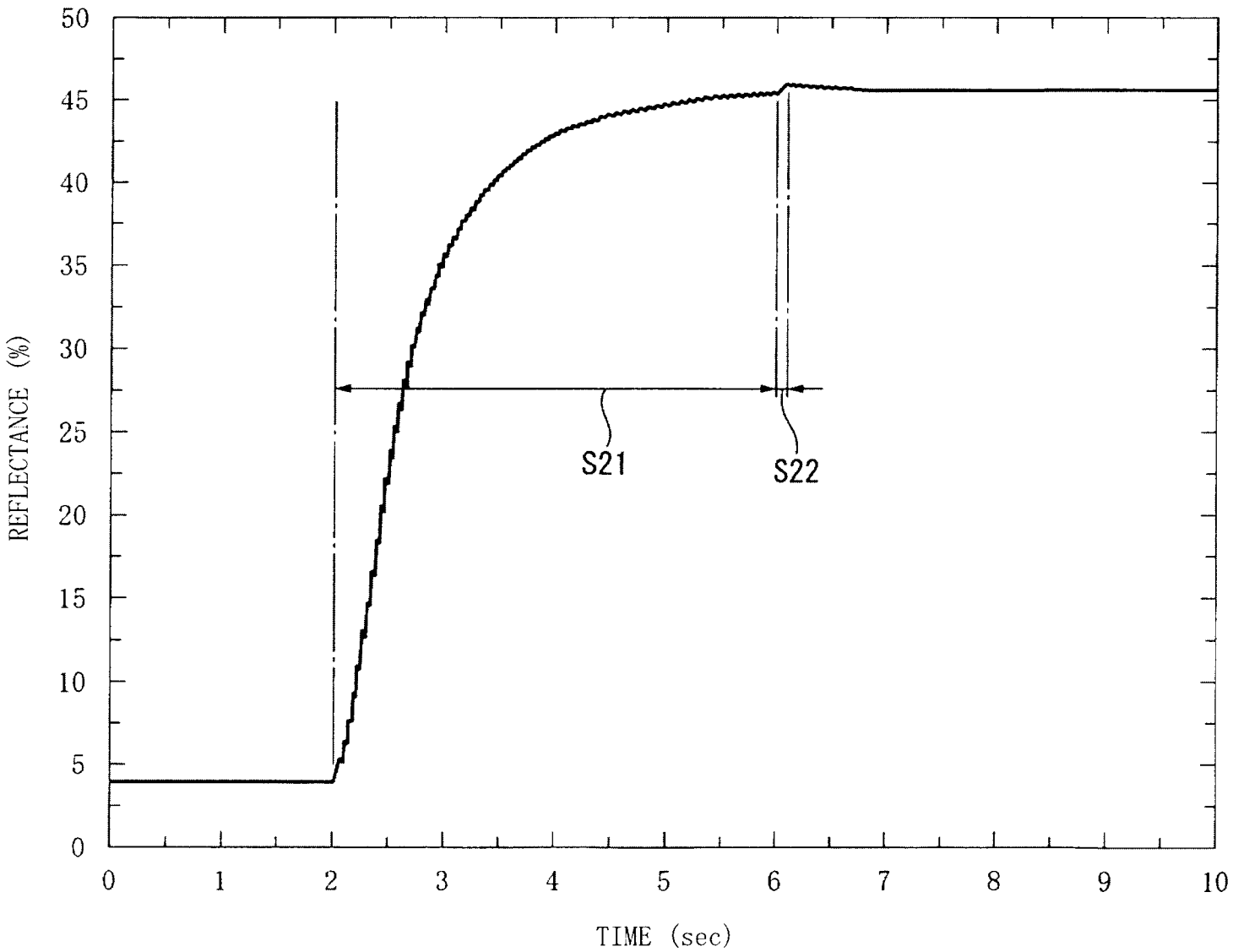
FIG. 13 is a graph showing the change in reflectance in the second embodiment of the invention.

Reflectance changes as shown by the graph in FIG. 13 in this second embodiment of the invention.

The second embodiment of the invention has the same effect as the first embodiment.

(4) In addition, because only a low level signal is applied as the second pulse in the second pulse application step S22 and writing white then stops, the second pulse does not change from low to high, and a drop in reflectance in the second pulse application step S22 can be prevented as shown in FIG. 13.

However, because the first embodiment applies the second pulse for two periods (applies the 100 ms low signal twice), the final reflectance achieved is higher in the first embodiment.

(5) In addition, because the first pulse application step S21 starts with a low signal and thus starts by writing white, and the second pulse application step S22 ends with a low signal and thus ends by writing white, white is written one more time than black is written.

As a result, the reflectance of the white display can be increased and display quality can be improved. More specifically, because the black particles 331 are smaller than the white particles 332 as described above, response is faster when writing black than when writing white, and the black particles 331 can move sufficiently when a short pulse is applied. Reflectance sufficient for a black display (such as 4%) can therefore be achieved even if the write count of the black display is less than the write count of the white display.

Therefore, by writing white, which has a slower response time than black, more times than black, and applying the second pulse with a long pulse width as a signal for writing white, both white and black can be displayed at the respective maximum reflectance (such as 4% for black and 48% for white), and the electrophoretic display elements of the display panel 30 can be reliably driven to saturation.

Embodiment 3

A timepiece according to a second embodiment of the invention is described next.

Figure 14:
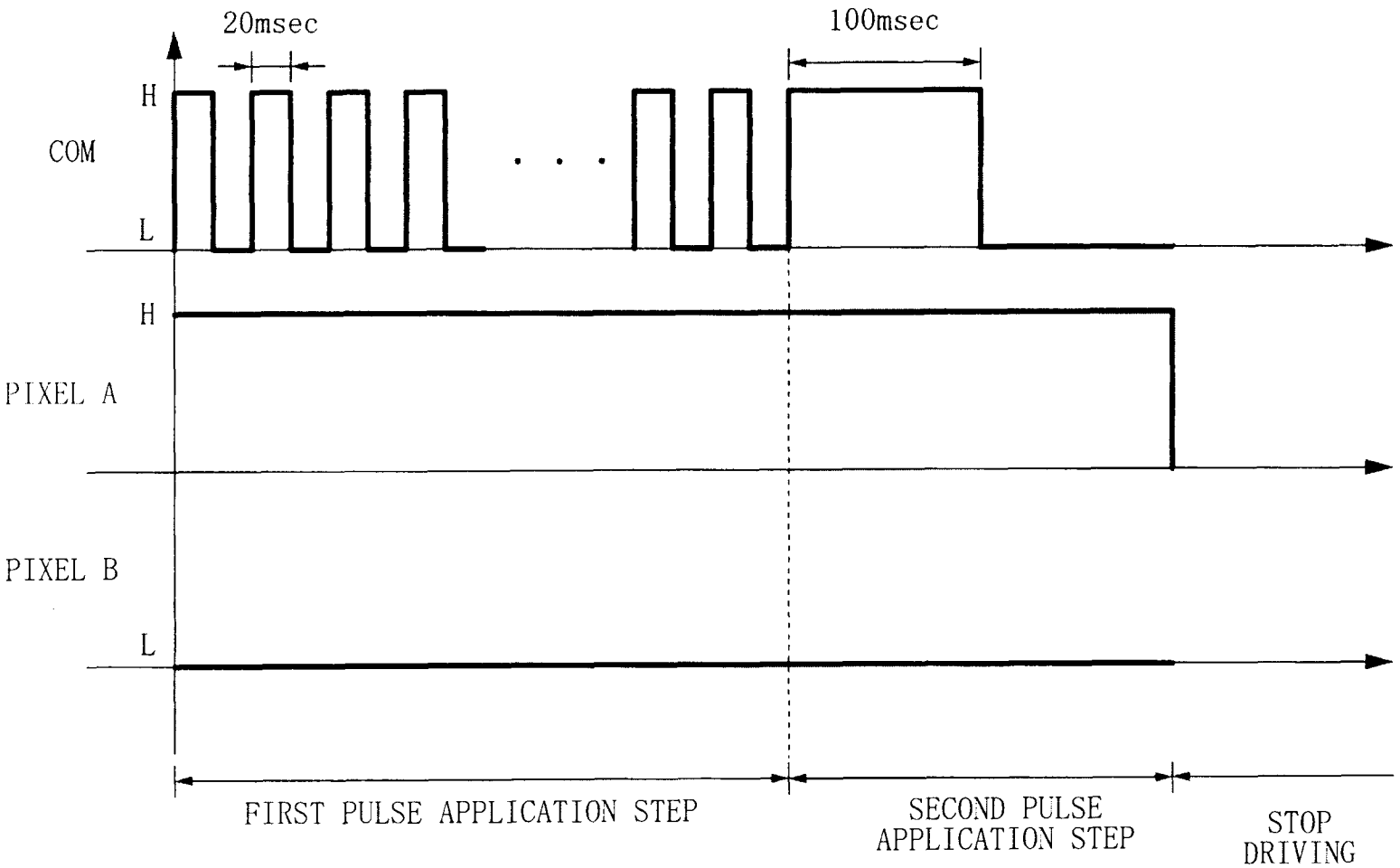
FIG. 14 is a timing chart showing the drive signal in a third embodiment of the invention.

The timepiece according to this third embodiment of the invention differs from the timepiece of the first and second embodiments in that the number of drive pulses applied by the controller 42, and specifically the number of second pulses input in the second pulse application step S22, differs from the number of pulses applied in the first and second embodiments as shown in FIG. 14. Other aspects of this embodiment are the same as in the first and second embodiments, and further description thereof is omitted or simplified.

The controller 42 controls updating the display according to the flow charts shown in FIG. 7 and FIG. 8 and described in the first embodiment above.

As shown in FIG. 14, the controller 42 controls the first pulse application step S21 as described in the first embodiment. A first pulse is therefore applied to the common electrode 32, a high signal is applied to the pixels A that are to display white, and a low signal is applied to the pixels B that are to display black.

This third embodiment differs, however, in that inputting the first pulse starts when the pulse is high, that is, writes black.

After executing the first pulse application step S21 for 4 seconds, the controller 42 then executes the second pulse application step S22. In the second pulse application step S22 the controller 42 applies the second pulse for one cycle, that is high for 100 ms and low for 100 ms, to the common electrode 32. The second pulse thus applies a 100 ms pulse width high signal and then a 100 ms pulse width low signal, and then stops.

The controller 42 then executes the stop driving step S23 to stop applying signals and hold the electrodes 32 and 34 in the high impedance state.

Figure 15:
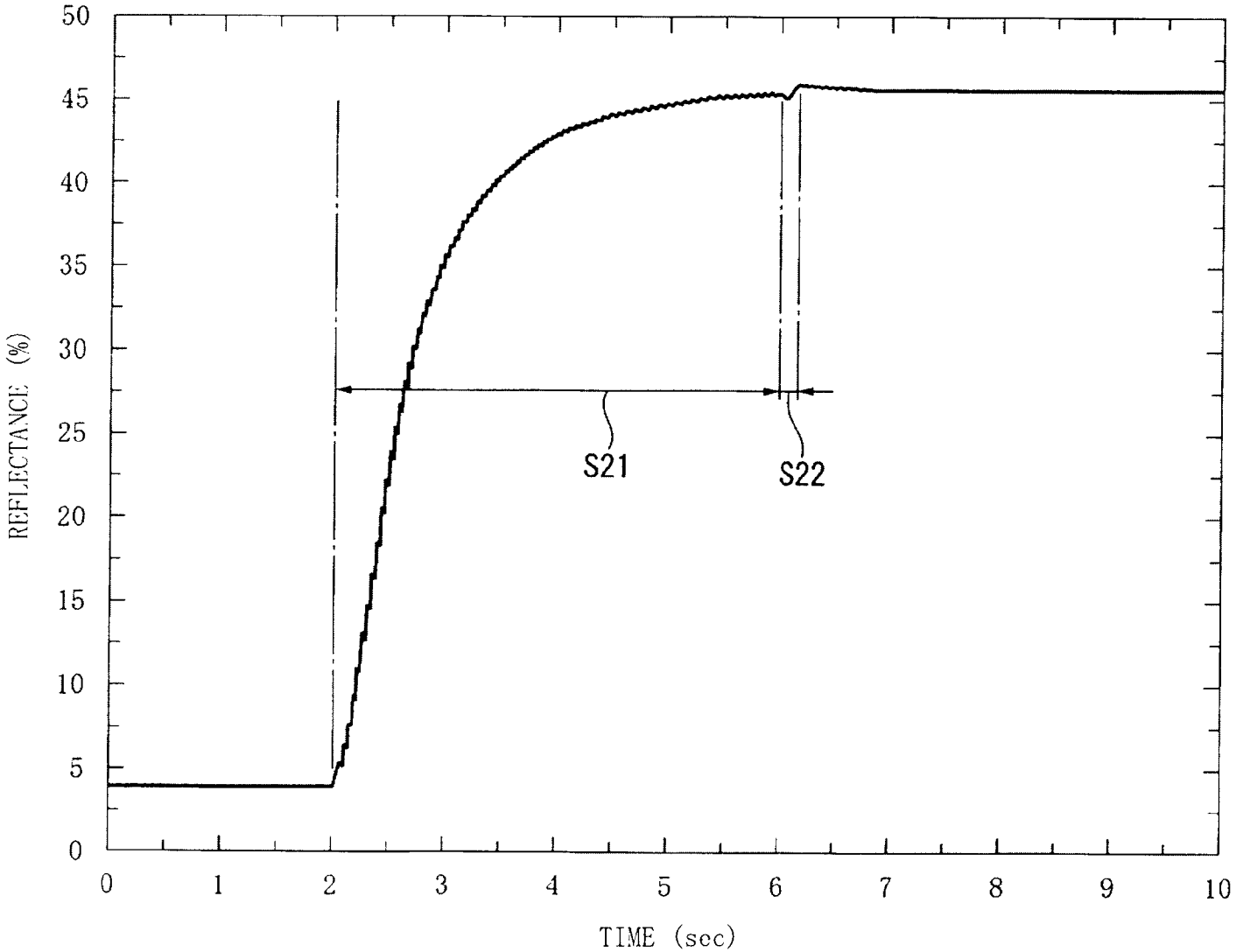
FIG. 15 is a graph showing the change in reflectance in the third embodiment of the invention.

Reflectance changes as shown by the graph in FIG. 15 in this third embodiment of the invention.

The third embodiment of the invention has the same effect as the first and second embodiments.

(6) In addition, because the second pulse in the second pulse application step S22 applies a high signal and then a low signal and then writing white stops, the final reflectance achieved at the end of the second pulse application step S22 can be improved as shown in FIG. 15 when control stops, and the drop in reflectance can be suppressed accordingly. More specifically, when switching from the first pulse application step S21 to the second pulse application step S22, the pulse signal applied to the common electrode 32 changes from low to high, but the drop in reflectance when switching to a high signal in the second pulse application step S22 is small because the pulse width of the first pulse is short. Furthermore, because there is no change from a long pulse width low signal to a high signal in the second pulse application step S22 as there is in the first embodiment, a drop in reflectance at the end of the second pulse application step S22 such as occurs in the first embodiment can be prevented. The reflectance of the white display can therefore be increased and the display quality can be improved.

Other Embodiments of the Invention

Preferred embodiments of the invention are described above but the invention is not so limited and can be modified and improved in various ways without departing from the scope of the accompanying claims.

The embodiments described above always execute the display redrawing process S2 including the first pulse application step S21 and the second pulse application step S22 when updating the image display. Alternatively, however, flicker-suppressing drive control can be applied using the display redrawing process S2 of the invention, or drive control that uses only pulses with a long pulse width and does not address flicker, can be selected according to the display content.

For example, the flicker-suppressing drive control method of the invention may be usually applied while drive control without flicker suppression can be applied when it is desirable to use flicker as a desirable display effect to highlight the change in displayed content. Drive control without suppressing flicker can conversely enhance the visual display when highlighting the change in displayed content by producing flicker is desirable, such as to announce the time when an alarm sounds or when displaying a warning, or to emphasize the appearance of falling snow or leaves.

The pulse width of the first pulse and the pulse width of the second pulse are also not limited to the values used in the foregoing embodiments. The pulse widths may be set appropriately according to the characteristics of the electrophoretic display elements to be controlled.

More specifically, the first pulse may be set to a pulse width that is short enough so that the viewer cannot discern any flicker when the first pulse is applied at the beginning of the display redrawing process. In order to increase movement of the particles 331 and 332, the pulse width is also preferably as long as possible within the range that will not cause flicker.

The pulse width of the second pulse may be set in the range that improves image contrast while also assuring sufficient image retention when the second pulse is applied in the second half of the display redrawing process.

For example, the pulse width of the first pulse is preferably less than 25 ms, and the pulse width of the second pulse is preferably greater than or equal to 25 ms.

Further preferably, the pulse width of the second pulse is set to 2 to 30 times the pulse width of the first pulse.

If the pulse width of the first pulse is too short, the particles 331 and 332 cannot be caused to move and a certain width is therefore necessary. It is therefore necessary to also set an appropriate lower limit for the pulse width of the first pulse, and this pulse width is set to 15 ms or longer, for example.

In addition, if the pulse width of the second pulse is too long, the user will be able to see that black and white are alternately written, redrawing the display becomes time-consuming, and image retention also drops. It is therefore necessary to also set an appropriate upper limit for the pulse width of the second pulse, and this pulse width is set to 200-300 ms or less, for example.

The pulse width of the second pulse is thus not limited to a range of 2-30 times the pulse width of the first pulse, and may be greater than this range of 2-30 times the pulse width of the first pulse if the above conditions are met.

The threshold for switching application of pulses of different pulse widths is not limited to a range of 80-90% of the targeted maximum reflectance, and may be less than 80% or more than 90%. The specific threshold value may be set according to the specific electrophoretic display device 3 in which the invention is used.

Furthermore, two different pulses, a first pulse and a second pulse, are applied in the embodiments described above, but the invention is not so limited. More specifically, three or more pulses of different pulse widths may be sequentially applied starting from the pulse with the shortest pulse width.

For example, a first pulse with a 20 ms pulse width may be applied first until the reflectance reaches 70% of the targetted maximum reflectance, a second pulse with a 60 ms pulse width may then be applied until the reflectance reaches 85% of the targetted maximum reflectance, and a third pulse with a pulse width of 100 ms may then be applied.

Further alternatively, first to n pulses ranging in pulse width from 20 ms to 21, 22, . . . 97, 98, 99, and 100 ms in 1 ms increments per period may be sequentially applied.

If the applied pulse width can be changed in more stages, the reflectance can be changed smoothly until the targetted maximum reflectance is reached without noticeable flicker, and the display can be redrawn smoothly with high display quality.

The embodiments described above apply the invention to a dot matrix display panel 30 using an active matrix drive circuit with a TFT circuit, but the invention can also be applied to segmented display panels having electrodes shaped like numbers or other display patterns. Note that if a segment display panel is used the data transfer component 421 and data transfer step S1 can be omitted.

The foregoing embodiments describe a black and white, two particle electrophoretic system using black particles 331 and white particles 332, but the invention is not so limited. More specifically, the invention can also be applied to single particle electrophoretic devices having blue/white particles, or a combination other than black and white.

Tests demonstrated that the electrophoretic display device 3 and the drive method of the invention are effective even when the temperature of the environment where the electrophoretic display device 3 is used changes. The invention can therefore be used in electrophoretic display devices that are used in different temperature environments.

The electrophoretic display device of the invention can be used in a wide range of electronic devices that have a display panel using electrophoretic devices, including personal digital assistants (PDA), cell phones, digital cameras, video cameras, printers, and personal computers.

The best modes and methods of achieving the present invention are described above, but the invention is not limited to these embodiments. More specifically, the invention is particularly shown in the figures and described herein with reference to specific embodiments, but it will be obvious to one with ordinary skill in the related art that the shape, material, number, and other detailed aspects of these arrangements can be varied in many ways without departing from the technical concept or the scope of the object of this invention.

Therefore, description of specific shapes, materials and other aspects of the foregoing embodiments are used by way of example only to facilitate understanding the present invention and in no way limit the scope of this invention, and descriptions using names of parts removing part or all of the limitations relating to the form, material, or other aspects of these embodiments are also included in the scope of this invention.

What is claimed is:

1. A drive method for an electrophoretic display device that has an electrophoretic device composed of a suspension fluid containing electrophoretic particles disposed between a common electrode and a plurality of pixel electrodes, driving the electrophoretic device by applying voltage between the common electrode and the plural pixel electrodes; and redrawing the display to change the displayed image, the redrawing including applying a first pulse train that repeats first potential and a second potential, to the common electrode until a reflectance of the displayed image reaches a threshold value set to at least 80% and less than 100% of a targeted maximum reflectance, applying one of the first potential, and the second potential to a first pixel electrode while applying the first pulse train according to the updated display content, applying a second pulse train that repeats the first potential and the second potential, after the threshold value is reached, to the common electrode, each pulse of the second pulse train having a longer width than that of each pulse of the first pulse train, and applying the one of the first potential and the second potential to the first pixel electrode while applying the first pulse train;

wherein the electrophoretic display device has no holding electrode.

2. The drive method for an electrophoretic display device described in claim 1, wherein the pulse width of each of the second pulse train pulses is about 2 to about 30 times the pulse width of each of the first pulse train pulses.

3. The drive method for an electrophoretic display device described in claim 1, wherein:

the electrophoretic particles comprise electrophoretic particles of a first color for displaying a first color and electrophoretic particles of a second color for displaying a second color, the first color electrophoretic particles each being within a first size range and the second color electrophoretic particles being within a second size range that is different from the first size range, the common electrode drive pulse repeatedly alternates between a first-color writing voltage that changes the displayed image to the first color and a second-color writing voltage that changes the image to the second color; and the last pulse in the common electrode drive pulse train is (i) the first-color writing voltage when the first size range is larger than the second size range, and (ii) the second-color writing voltage when the second size range is larger than the first size range.

4. The drive method for an electrophoretic display device described in claim 3, wherein:

the first pulse train in the common electrode drive pulse train in the display redrawing process is the first-color writing voltage when the electrophoretic particles of the first color are larger than the electrophoretic particles of the second color, and the first pulse in the common electrode drive pulse stream in the display redrawing process is the second-color writing voltage when the electrophoretic particles of the second color are larger than the electrophoretic particles of the first color.

* * * * *